US007487972B2

(12) United States Patent
Halliburton

(10) Patent No.: US 7,487,972 B2
(45) Date of Patent: Feb. 10, 2009

(54) BALLOON AMUSEMENT GAME

(75) Inventor: Ronald D. Halliburton, Delray Beach, FL (US)

(73) Assignee: Benchmark Entertainment L.C., Hypoluxo, FL (US)

( * ) Notice: Subject to any disclaimer, the term of this patent is extended or adjusted under 35 U.S.C. 154(b) by 0 days.

(21) Appl. No.: 11/984,163

(22) Filed: Nov. 14, 2007

(65) Prior Publication Data

US 2008/0119252 A1 May 22, 2008

Related U.S. Application Data

(60) Provisional application No. 60/858,707, filed on Nov. 14, 2006.

(51) Int. Cl.
*A63F 9/00* (2006.01)

(52) U.S. Cl. ..... 273/458; 273/459; 273/440

(58) Field of Classification Search ..... 273/440, 273/457–460, 429–432, 445
See application file for complete search history.

(56) References Cited

U.S. PATENT DOCUMENTS

| | | | | |
|---|---|---|---|---|
| 3,608,903 | A * | 9/1971 | Cooper et al. | 273/282.1 |
| 3,685,825 | A * | 8/1972 | Dorazio | 273/458 |
| 3,795,400 | A * | 3/1974 | Glass et al. | 273/458 |
| 4,169,593 | A * | 10/1979 | Wood | 273/458 |
| 4,171,806 | A | 10/1979 | Goldfarb | |
| 4,243,220 | A | 1/1981 | Shelley | |
| 5,324,045 | A * | 6/1994 | Trawick et al. | 273/458 |
| 5,992,853 | A | 11/1999 | Rudell | |
| 6,402,582 | B1 * | 6/2002 | Sherer | 446/220 |
| 7,134,665 | B2 * | 11/2006 | Holsten et al. | 273/458 |
| 2003/0073479 | A1 | 4/2003 | Wilson | |
| 2006/0232014 | A1 * | 10/2006 | Holsten et al. | 273/458 |

* cited by examiner

*Primary Examiner*—Raleigh W. Chiu
(74) *Attorney, Agent, or Firm*—Venable LLP; Andrew C. Aitken

(57) ABSTRACT

An amusement device for playing a skilled based game, that includes a balloon, a pump for inflating the balloon, a connecting hose for connecting the pump to the balloon, a release value for relieving pressure from the pressurized system, which includes the pump, the connecting hose, and the balloon. The game includes a countdown timer for providing a predetermined game interval, and an activation switch for the initiation of the play of the game and the countdown timer. A first detector is provided for detecting the successful exercise of skill during the play of the game and providing a signal to the controller reflecting the successful exercise of skill. A controller performs a number of functions including, in response to said signal reflecting the successful exercise of skill, activation of the air pump to operate during said game interval wherein the air pump will cause balloon to inflate. In the event a signal is recognized by the controller for a sufficient time over said predetermined game interval, the pump will be correspondingly activated for a duration which will cause the balloon to burst. After an unsuccessful play of the game the controller will activate the release valve to allow any pressure in said system to dissipate.

13 Claims, 7 Drawing Sheets

BALLOON AMUSEMENT GAME

CROSS REFERENCE TO RELATED APPLICATION

This application claims the benefit of U.S. Provisional Application No. 60/858,707, filed Nov. 14, 2006, entitled Balloon Amusement Game.

The present invention relates to a coin operated amusement game that provides tickets for redemption upon successful play.

BACKGROUND OF THE INVENTION

There is persistent demand for new games for general amusement centers such as arcades or family fun centers. It is generally accepted that customers are more likely to repeat visits to game centers if the game attractions provided by the operator are new and different. New games may also generate publicity resulting in increased traffic and increased play at such locations. In general, games that are popular are those having a game concept that is quickly and easily understood by a prospective player.

SUMMARY OF THE INVENTION

The object of the present game is to keep a plurality of game pieces in play long enough to allow a balloon to inflate and burst. The game pieces are introduced onto an inclined surface that slants towards the front of an enclosed cabinet. It is the object of the game to activate solenoids which in turn are connected to kickers that propel a game piece in play. If the game pieces roll down the inclined surface beyond a predetermined line or region, referred to as the "Red Zone", they are detected and a signal is sent to a processor to allow the countdown to proceed. When all the pieces are above the red zone the countdown is held.

The game field is an inclined surface that slopes upwardly from the front of the game cabinet. The detector is provided across the playfield near the front of the cabinet that defines the Red Zone. If a game piece is within the red zone it is detected by the detector. The detector consists of an infrared light source which projects a beam of infrared light towards a detector across the play field in a direction parallel with the front of the cabinet. If the beam of light is interrupted by a game piece, there is an absence of a signal from the detector.

Upon the initiation of play, a counter or game timer is set for 150 increments of time which begins to count down when the credit button is activated. When the game starts an air pump starts blowing up a balloon and this process will continue until the game timer counts out or the balloon is burst. The amount of time on the game timer can be set by the operator. If the player can keep the game going long enough to burst the balloon, the player is awarded a prize or jackpot. A jackpot value is displayed on an electronic display board and increases each time the game is played and a balloon is not burst. If the balloon is not burst during a game, an air value releases the air in the balloon and it is ready for the next game play. This process repeats until the balloon is burst at which time a balloon wheel moves to allow a new balloon to be positioned in alignment with the path of air flow from the air pump.

The countdown of the game timer proceeds when any one of the game pieces is in the red zone. If all the balls are outside of the red zone the countdown is held. In other words, when all the balls are in play above the red zone the countdown timer is off and the balloon has a longer time to inflate. The inflation of the balloon essentially serves to time the game time. A player tries to keep the game going long enough to burst the balloon. The anticipation of a balloon reaching the size that is about to burst is an exiting feature of the game as well as the bursting action itself. As the balloon increases size, the anticipating and the excitement of the players and those watching the play of the game increases. The use of an inflating balloon in connection with a skilled based game is a novel development that results in a fun game to play.

In an alternative embodiment of the game, a player exercises other skilled based activities as the balloon is blowing up and a timer counts down. For example a player may be provided with a task such as completing a visual puzzle, or unscrambling a series of words as the countdown proceeds. If designated tasks are timely completed, the air pump will remain engaged to the balloon.

In yet another contemplated embodiment, a player attempts to perform a task or skill before the balloon is blown up and the bursting of the balloon is reflected of the failure to exercise the requisite skill in the time required.

DETAILED DESCRIPTION

Figure 1:
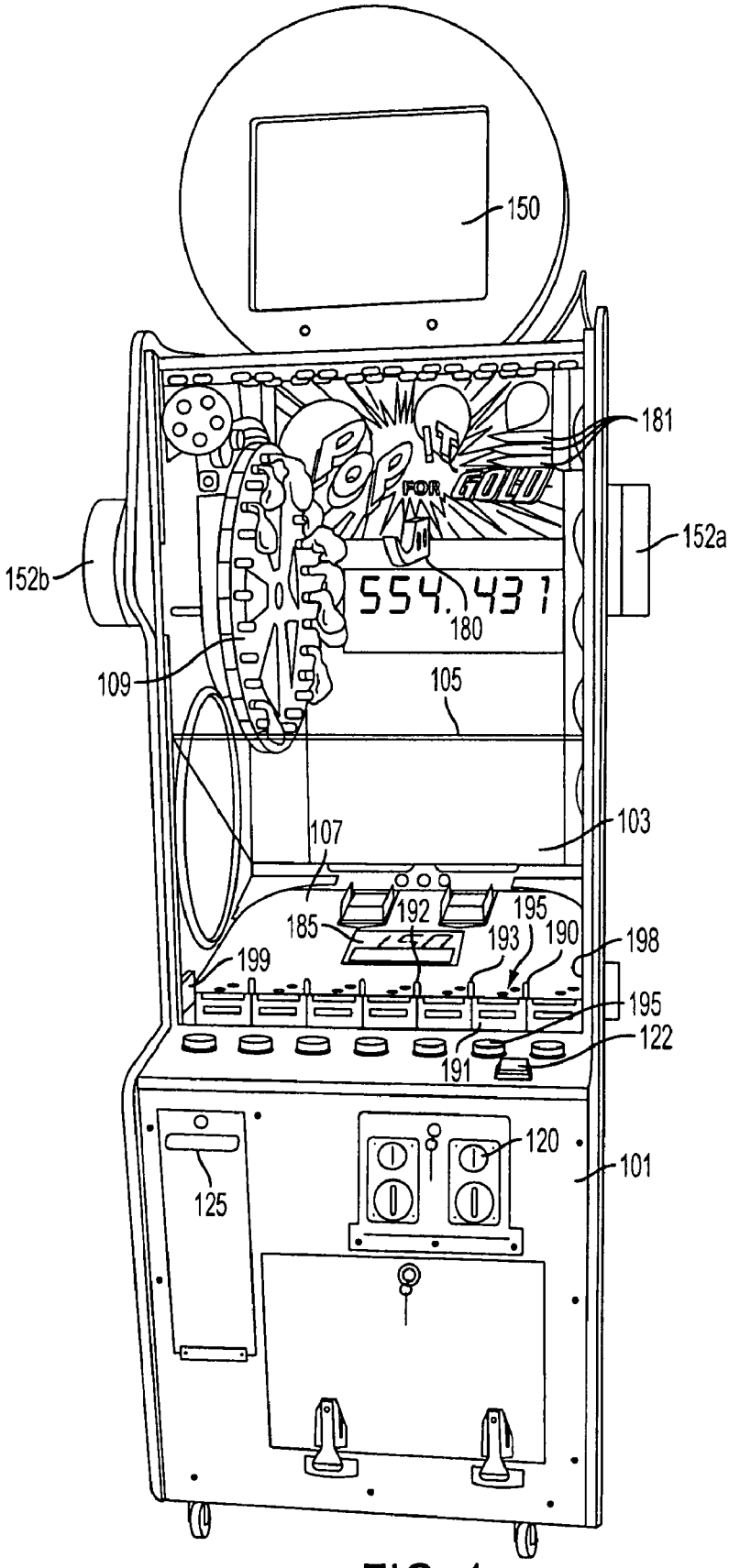
FIG. 1 is a front perspective view of a first embodiment of the invention.

Now referring to FIG. 1, the game includes a cabinet 101 that has a front transparent viewing panel 103 that allows the players to see the inclined playfield 107 and the balloon array wheel 109. The playfield 107 and the balloon array wheel 109 are separated by inclined panel 105 that also serves to direct balloon debris away from the top of the cabinet.

A coin acceptor 120 is provided on the front of the cabinet that is designed to receive coins or tokens and detect whether they are genuine. If the coins are genuine, and the appropriate amount of money or tokens are detected, a credit switch 122 is activated which allows the payer to initiate play of the game. While in the embodiment depicted in FIG. 1 is designed to receive uses coins or tokens, in alternative contemplated embodiments acceptors for paper currency or a magnetic cards may be provided to provide a credit. Depicted on the left of the cabinet 101 is the front of the ticket distributor 125.

At the top of the device a LCD screen 150 is provided that displays images designed to attract players. A CD player is provided within the cabinet that provides a video signal to the screen which is controlled by a central computer or processor. This screen may also be provided with video programming to instruct players on how to play the game and may be provided with visual commentary on the particular play of the game. On the sides of the cabinet are speakers 152 A and 152 *b*. The speakers provide audio for the animation provided for the LCD screen and sound effects for the game.

As seen in FIG. 1 the game playfield has seven lanes across the front of the cabinet and a ball kicker associated with each lane. Each lane is defined by two pegs, such as pegs 190, and 193 which define lane 195, The pegs extend out from the playfield at a location near the front of the transparent viewing panel 103. When a ball is within one of the lanes defined by the pegs it may be contacted by a kicker. For example kicker 191 corresponds to the lane 195 and may be activated by kicker switch 195. If the kicker hits a game piece in the lane it will be propelled up the inclined surface. The kickers function to propel balls up on the playfield like the flippers found on conventional pinball games but do not pivot on an axis. It is contemplated that alternative embodiments of the invention my employ alternative methods of causing the game pieces to be launched into play including conventional pinball flipper devices.

Extending from the rear wall is a detector arm 180 that includes a detector to sense whether or not a balloon is being inflated. This detector is also consists of an infrared light source and photo detector. A balloon that is being inflated will interfere with the detection of light that originates from a light source on the end of the arm which is directed back towards a detector. If the central processor detects the absence of a signal after a predetermined time, it will infer that there is not a balloon at the wheel location, stop the game, and send a signal to the wheel motor to advance the wheel to the next position. The central process will also provide a new credit to the player.

Also shown are three spikes 180 that will engage and pop a balloon if the balloon is inflated to an extent that it comes into contact with the spike.

The playfield is elevated approximately 8 degrees from the bottom edge. In the preferred embodiment there are four 2 inch high energy balls, commonly referred to as "superballs" that are captured on the play field. The seven ball kickers are powered by seven solenoids located underneath the play field and each has a corresponding activation button provided on the front of the cabinet. In the center of the playfield is the countdown timer display 185.

Upon activation of the credit switch of the game a number of events simultaneously occur. Each of the kickers is sequentially activated by the central processor to propel all the balls into play. At that time the air pump that blows up the balloon is activated and the countdown time is activated. If any of the balls are in the red zone the countdown timer counts down. Play proceeds and the player can push a button for each. In the embodiment depicted, only one kicker may be activated at a time. Play will proceed until the countdown timer reaches zero.

Figure 2:
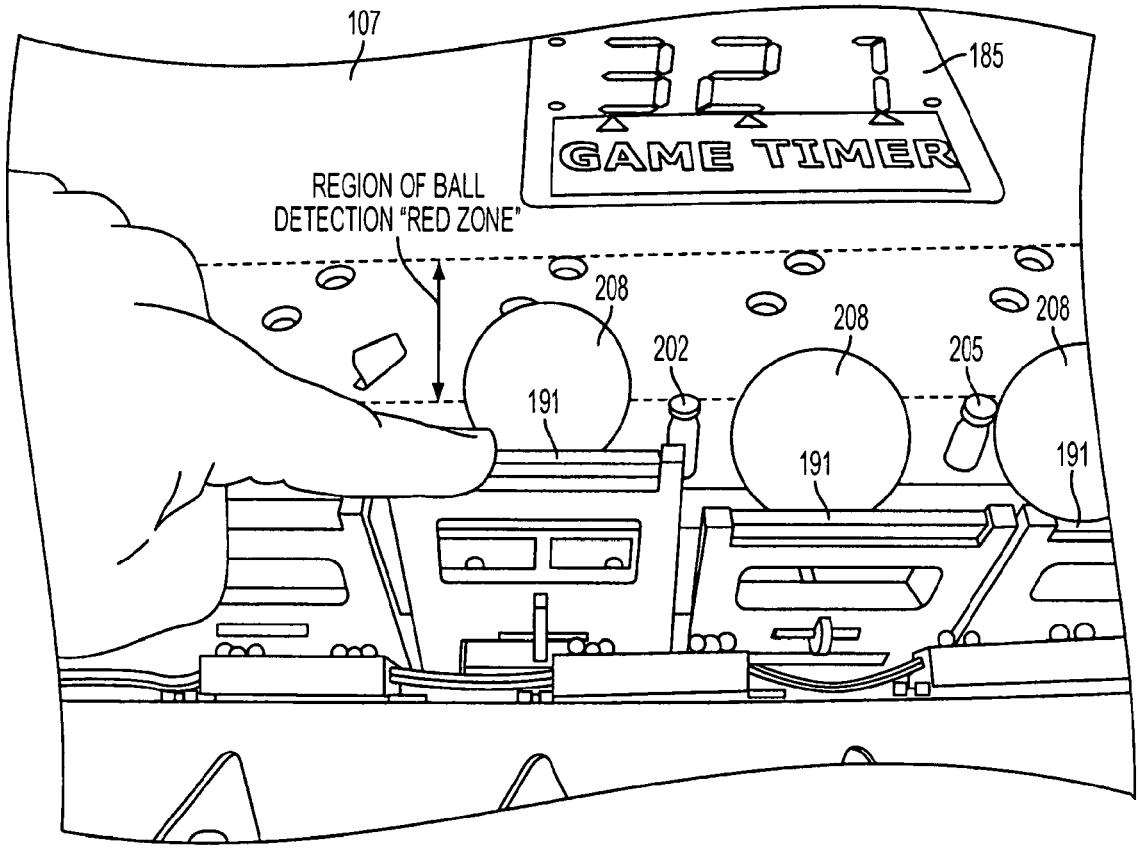
FIG. 2 is a perspective partial view of the inclined play field and the kickers that are designed to contact the game pieces and propel them up the inclined surface.

Now referring to FIG. 2, a ball 208 is shown in a lane defined by peg 202 and 205. A dotted line is shown that illustrates a red zone and a ball that interrupts this line will cause the absence of the signal from the photo detector.

Figure 3:
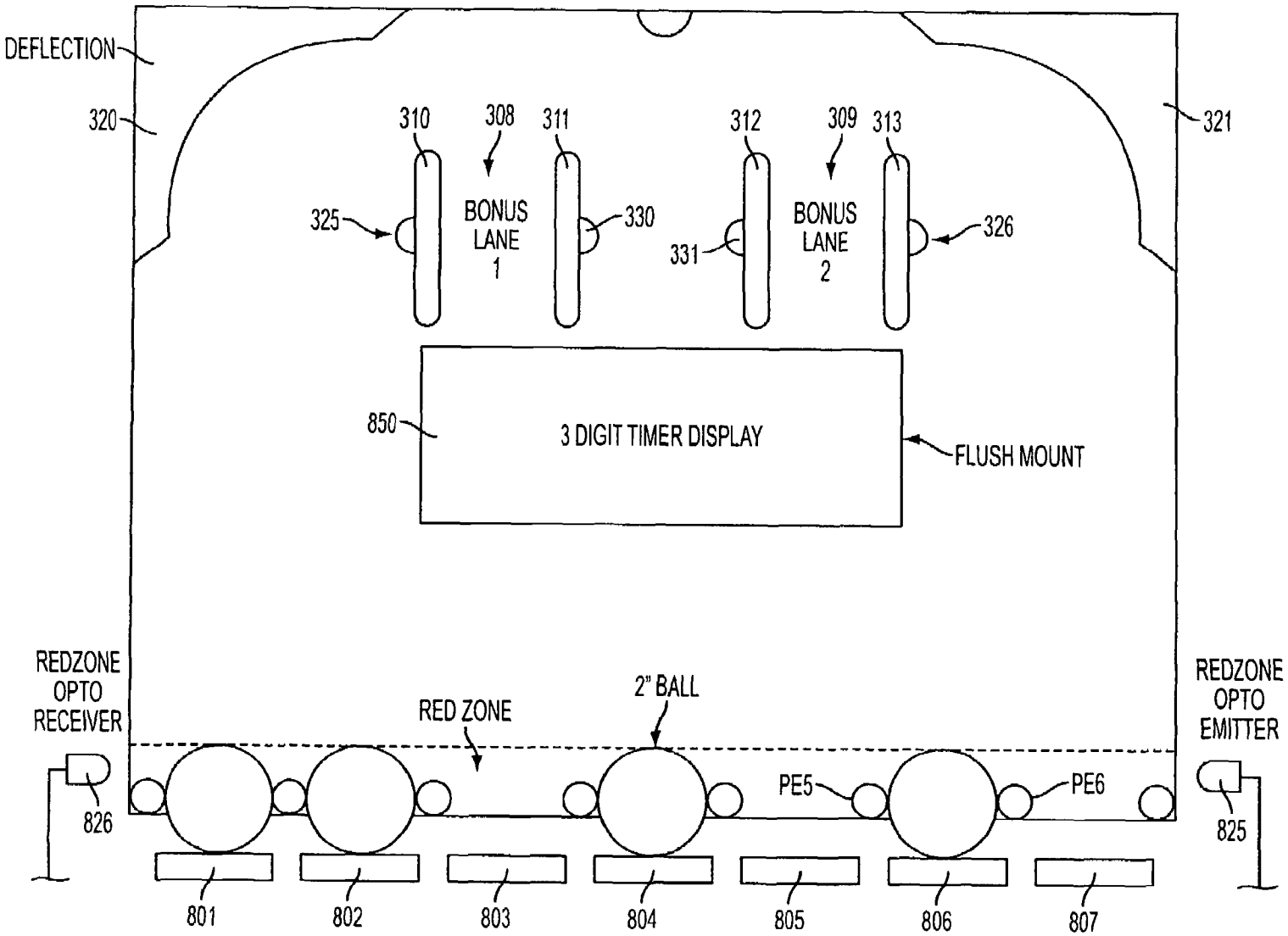
FIG. 3 is a top view of the play field.

Now referring to FIG. 3, the play field includes two bonus lanes 308 and 309 which are defined by rails 310, 311, 112 and 313. At the corners of the play field are deflectors 320 and 321 which will guide balls towards the center of the play field and towards the bonus lanes. Optical sensors 325 and 325 are provided for each bonus lane to detect the passage of a ball through the lanes. A light source 330 and 331 is positioned opposite the respective sensors. If a ball passes through the bonus lane a bonus time is added to the play. In a preferred embodiment this time is added after the countdown has expired. When play has expired, the air pump is provided with additional time to run and the player can watch as the balloon further expands. This bonus time can be displayed on a LED panel next to the bonus that is tracked. Also shown in FIG. 3 are the kickers 801, 802, 803, 804, 805,806 and 807 which are provided for each of the seven lanes. An optical emitter 825 is posited on one side of the play field that sends an optical signal to the optical receiver 826. If a ball interrupts the path of light, the absence of a signal is interrupted by a central processor as reflecting that a ball is presenting the red zone. A display countdown time 850 is mounted flush with the play field.

Figure 4:
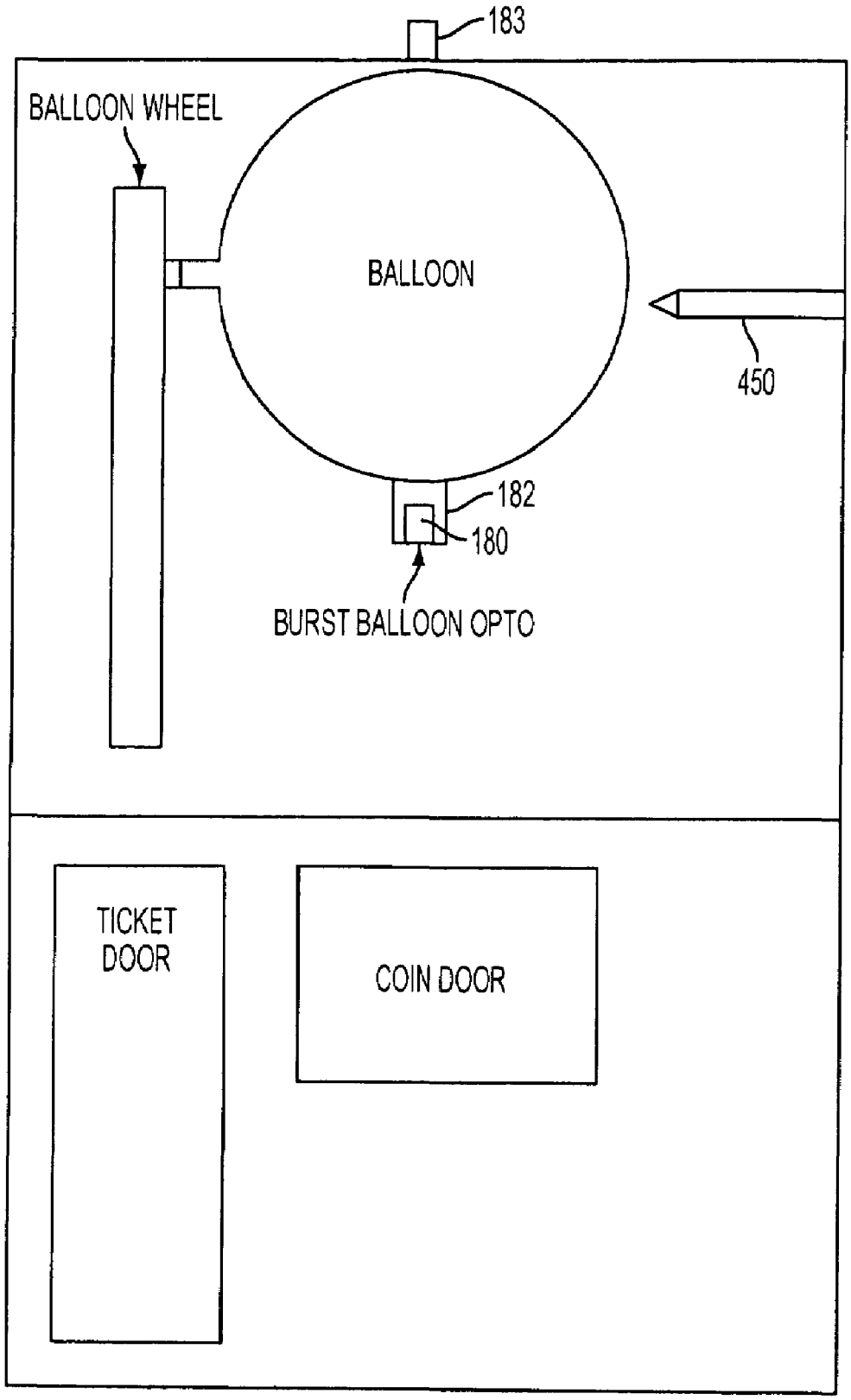
FIG. 4 is a schematic front view of the device including the burst balloon optical emitter 182 and detector 183.

FIG. 4 is depicts a balloon in an in inflated position. Wherein the balloon burst optical sensor 182 and 183 and a balloon interferes with the path of light that is emitted from arm 180. If the balloon inflates enough to engage the spike 450 it will be broken. This detection will also detect the absence of a balloon or defective balloon when play is initiated. After a predetermined time, for instance after 5 seconds after play has started, if the light beam is not interrupted, then the CPU will cause the game to stop and the wheel to be moved to the next location and a new credit will be given to the player. This detector is also used to detect that a balloon has burst. In this regard, the lack of a signal for a predetermined time during which play is active flowed by the detection of a signal will indicate that a balloon has burst.

Figure 5:
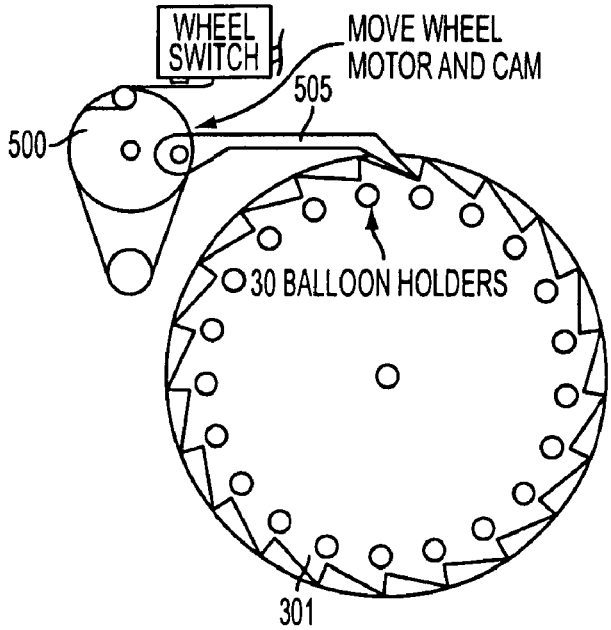
FIG. 5 is front view of the balloon wheel and balloon move wheel motor.
Figure 6:
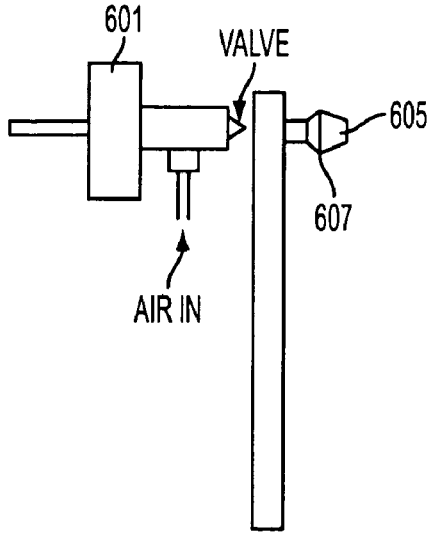
FIG. 6 is a side schematic view of the balloon wheel.

FIG. 5 is a front view of the balloon wheel. In this embodiment the wheel can hold 30 balloons. When the balloons have all been used it must be replaced by the game operator. In one contemplated embodiment and additional wheel is provided which can be preloaded with balloons. A wheel with a saw tooth profile or ratchet is driven by a cam 500 and paw 505 arrangement. A wheel switch 502 turns on wheel motor that drives the cam 500. As the cam 500 is driven it cause the paw it to disengaged from a first location on the ratchet and engages the next adjacent ratchet location and then drive the wheel to the next position causing the wheel to align the next balloon in front of the air valve. This arrangement will also ensure that the wheel is positioned at precise locations to align with the air flow. Next the linear stepper motor is activated to engage the valve to the rear of the wheel. The wheel stays in place until a balloon is burst and a jackpot is awarded. As best seen in FIG. 6, when the wheel is moved, a linear stepper 601 motor disengaged a valve assembly from the wheel and the wheel is advanced by the wheel motor to the next balloon location, when the spring loaded cam is locked in the next position, the valve is advanced towards the wheel and the valve engaged the rear of the wheel where the balloon holder 605 passes through the wheel. The balloon holder is which a tubular structure that extends through the wheel is. A bulged area 607 is provided on the balloon holder to firmly hold the neck of the balloon.

Figure 7:
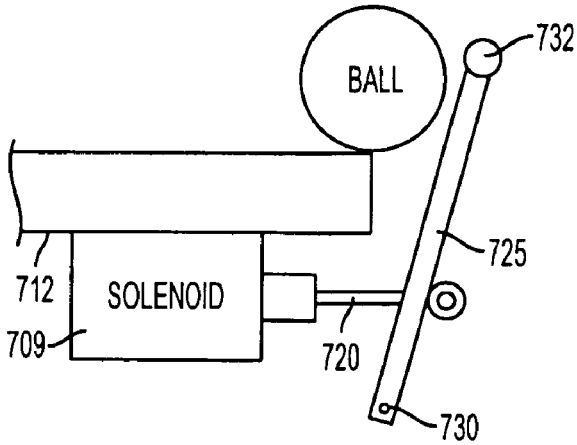
FIG. 7 is a side schematic view of a ball kicker.

FIG. 7 illustrates the ball kicker. A solenoid 709 is attached the rear surface 712 of the play field which may be activated by the switch on the front of the cabinet by a player when the count down is active. When the switch is activated a linkage 720 is pulled into the solenoid which pulls arm 725 towards the solenoid causing the arm to pivots at point 730 and cause the top roller 72 to engage a ball in the lane. When the switch is released the arm returns to the first position.

Figure 8:
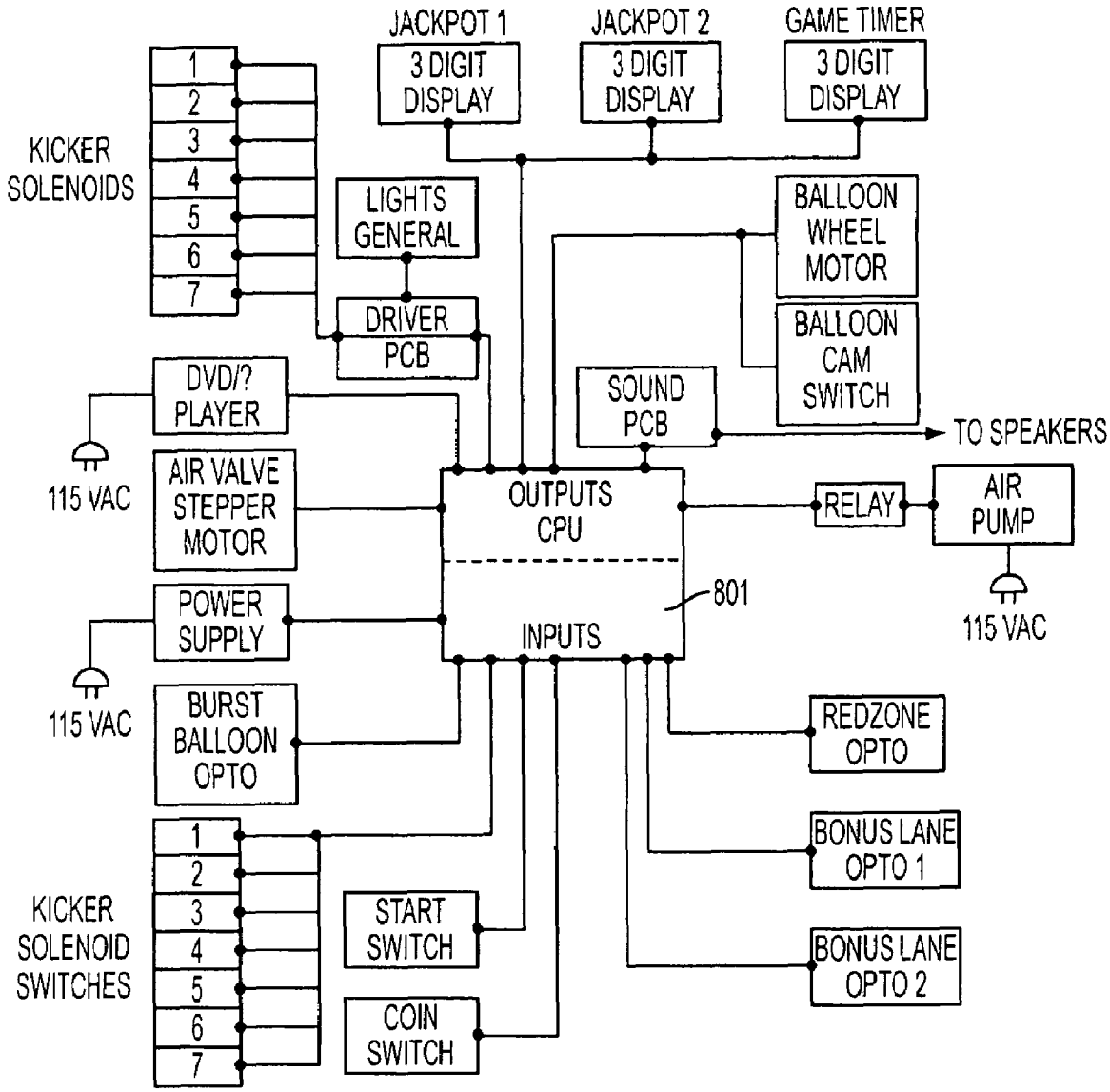
FIG. 8 is a schematic view of the electrical components of the game and the CPU or game controller.
Figure 9:
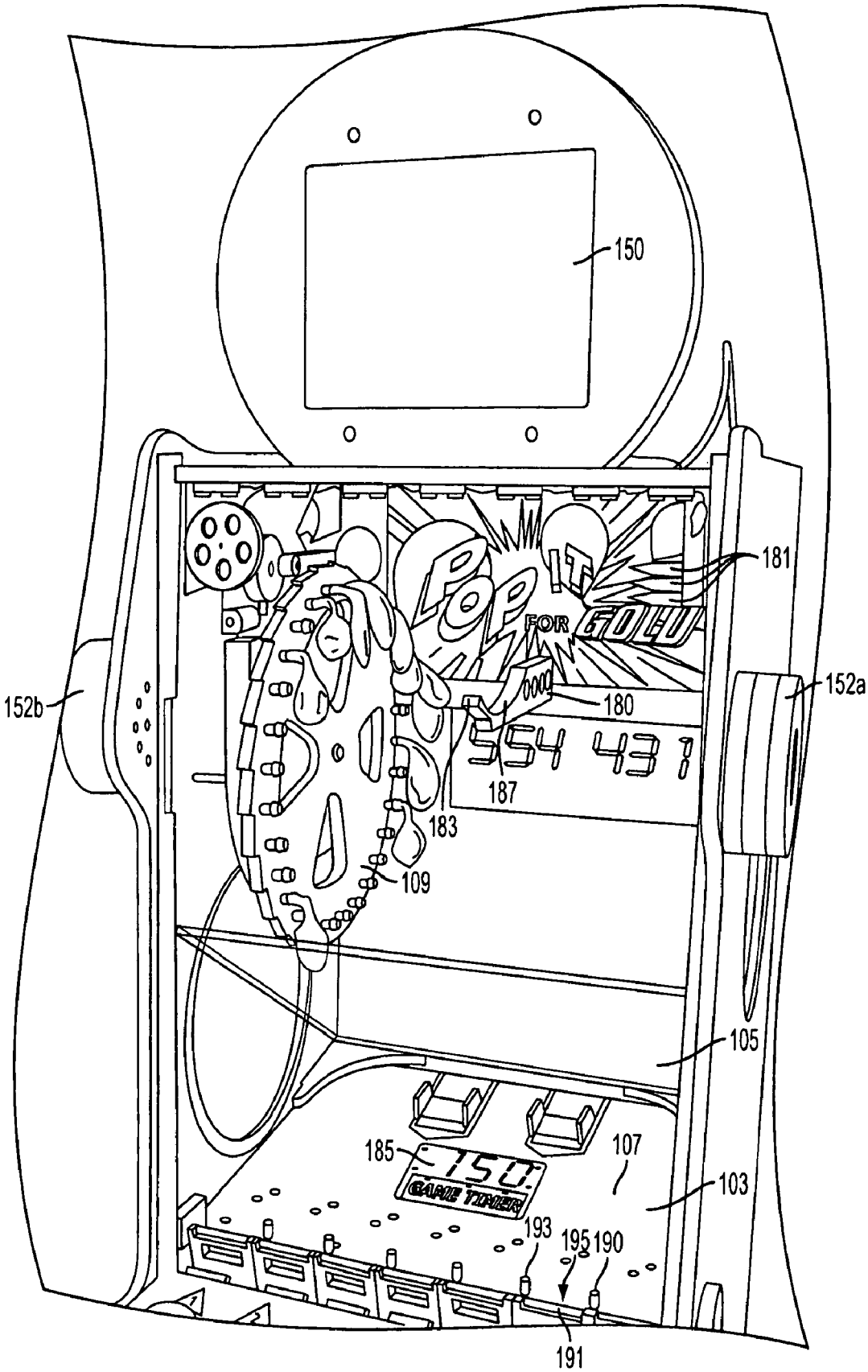
FIG. 9 is another perspective view of the game.

FIG. 8 schematically depicts the electronic components of the game including a plurality of inputs and outputs to the central processing unit 801. The inputs to the CPU include the power supply, the optical detector for the burst balloon, each of the switches for the activation of the solenoids, a start switch for the game, a coin switch from the coin detector, signals from the red zone optical detector sand the two bonus lanes. Signals from the CPU include a signal to a relay that activated the air pump, signals to control the sound board which in turn control the speakers. A signal to operate the Balloon wheel motor and Balloon cam switch, signals to the jackpot displays and the game count down timer, signals to the each of the solenoids and the various lights associated with each of the solenoids as well as general light used in the game; and the signal to operate the DVD player and a signal to operate the air value stepper motor 601. A separate power supply is provided for a number of the motors, pumps and players.

While the skilled based game that was disclosed is directed to a manner in which to maintain multiple balls above a predetermined region for a predetermined time duration that allows an air pump to inflate a balloon a sufficient time in which to burst, other skilled based may also be implemented in connection with the concept of allowing a balloon to inflate until it bursts. For example, a series of trivial question may be displayed on a display screen and the player may have to select the correct response within a certain time period in order to maintain operation of the air pump. If an answer is entered incorrectly, or is not answered correctly within a predetermined time, the air pump would be disabled until such time that a correct answer is again entered. In further alternative embodiments the exercise of skill could be implemented by the memorizing sequences of pictures or symbols, solving mathematical problems, or performing other brain teasers within a pre-designated time intervals. The problems and solutions could be displayed to the player on a touch screen.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

We claim:

1. An amusement device for playing a skilled based game, said device comprising a balloon, a pump for inflating said balloon, a connecting hose for connecting said pump to said balloon, a release value for relieving pressure from a pressurized system, said pressurized system comprising said pump, said connecting hose, and said balloon, a countdown timer for providing a predetermined game interval, an activation switch, for the initiation of said game and said countdown timer, a detector, for detecting the successful exercise of skill during the play of said game and providing a signal reflecting the successful exercise of skill to a controller, said controller, in response to said signal reflecting the successful exercise of skill allowing said air pump to operate during said game interval wherein said pump will cause balloon to inflate and, in the event said signal is recognized by said controller for a sufficient time over said predetermined game interval, said pump will be activated for a duration which would cause said balloon to burst, and said controller further activating said release valve after said predetermined game interval has elapsed allowing any pressure in said system to dissipate.

2. The device as recited in claim 1 further comprising an award dispenser and said controller is programmed to activate said award dispenser in response to the successful play of the game wherein said balloon will burst.

3. The device as recited in claim 2 wherein said award dispenser is a ticket dispenser and said award comprises tickets that may be redeemed for prizes.

4. The device as recited in claim 1 further comprising a sharp object, said sharp object in a fixed position at a predetermined location from an attachment point of said balloon, wherein as said balloon inflates and thereby enlarges a predetermined amount, it will contact said sharp object with sufficient force to cause said balloon to burst.

5. The device recited in claim 1 wherein said game comprises a plurality of game piece propelling devices that propel game pieces onto an inclined ramp, and a game piece detector, said game piece detector positioned to detect game pieces in a designated region of said ramp located at the lowest section and send a signal to said controller reflecting when at least one said piece is in said regions and wherein said signal is processed by said controller to deactivate said air pump, and wherein said air pump will be activated during said game interval when no signal is received wherein the object of said game is to maintain all the game pieces out of said designated region for a sufficient time to allow said pump to inflate said balloon a sufficient amount to cause it to burst.

6. The device as recited in claim 5 wherein said propelling device comprises an activation device, a game piece engagement device and a solenoid, wherein upon activation of said activation device, the solenoid is activated and causes said engagement device to move.

7. The device as recited in claim 5 wherein only a limited number of said propelling devices may be activated at a particular time.

8. The device as recited in claim 5 wherein said controller allows the enablement of a preselected number of propelling devices.

9. The device recited in claim 5 wherein said game pieces are balls.

10. The device in recited in claim 9 wherein said balls are comprised of an elastic material.

11. The device as recited in claim 5 further comprises targets, said targets further comprising sensors which will sense the contact with said game pieces, and upon the activation of said sensors, said sensor will send a signal to said controller, and said device further comprises a display panel, wherein a bonus award is displayed on said display panel reflecting an award provided to a player and the award is calculated said processed based upon a predetermined algorithm based upon the activation of said targets and the number of plays on the device that did not result in the bust of said balloon.

12. The device as received in claim 1, wherein the game comprises a trivia game and the air pump is activated for a predetermined time in response to the correct response to a trivia question.

13. The game recited in claim 1 further comprising a balloon magazine wheel for the provision of a plurality of balloons and further comprising a first motor for the rotation of said magazine wheel, and a balloon detector, said balloon detector positioned in a location to detect the presence of balloon that has been partially inflated at a time wherein said air pump is activated, and, in response to the detection of the presence of a balloon, said balloon detector will transmit a signal to said controller, and in the event that a signal is not transmitted from said balloon detector, said controller will stop the play of said game, and cause the activation of a first linear motor to disengage the air hose to said balloon holder, and then activate said first motor to rotate said wheel to the next angular position, and then activate said linear motor to cause air hose to engages the balloon holder at said next position, and then reactive a credit for the play of said game.

* * * * *